US006047535A

United States Patent [19]

Schroers et al.

[11] Patent Number: 6,047,535

[45] Date of Patent: Apr. 11, 2000

[54] METHOD FOR CONTACT-FREE ENERGY AND SIGNAL TRANSMISSION ON TEXTILE MACHINES, ESPECIALLY TWISTING MACHINES AS WELL AS DEVICE FOR PERFORMING THE METHOD

[75] Inventors: Paul Schroers, Viersen; Guido Spix, Kaarst; Stefan Kross, Viersen, all of Germany

[73] Assignee: Volkmann GmbH & Co., Germany

[21] Appl. No.: 09/135,476

[22] Filed: Aug. 17, 1998

[30] Foreign Application Priority Data

Aug. 16, 1997 [DE] Germany ..... 197 35 651

[51] Int. Cl.[7] ..... D01H 13/00

[52] U.S. Cl. ..... 57/100; 57/58.49; 57/58.53; 57/264; 57/404; 57/406; 310/71

[58] Field of Search ..... 364/470.01, 470.1; 318/16; 336/DIG. 2; 310/71; 340/310.07, 310.02; 57/264, 404, 406, 409, 417, 58.49, 58.52, 100

[56] References Cited

U.S. PATENT DOCUMENTS

| | | | |
|---|---|---|---|
| 3,875,732 | 4/1975 | Ellingham | 57/406 |
| 3,877,212 | 4/1975 | Canzler | 57/406 |
| 4,408,447 | 10/1983 | Sloupensky et al. | 57/264 |
| 5,161,361 | 11/1992 | Talley et al. | 57/264 |
| 5,479,771 | 1/1996 | Ballhausen et al. | 57/406 |
| 5,626,011 | 5/1997 | Ballhausen et al. | 57/406 |
| 5,628,177 | 5/1997 | Ballhausen et al. | 57/406 |
| 5,629,590 | 5/1997 | Yamamoto | 318/16 |
| 5,632,140 | 5/1997 | Ballhausen et al. | 57/406 |
| 5,637,973 | 6/1997 | Hirai et al. | 318/16 |
| 5,642,091 | 6/1997 | Coenen et al. | 340/310.2 |
| 5,814,900 | 9/1998 | Esser et al. | 307/104 |

FOREIGN PATENT DOCUMENTS

| | | |
|---|---|---|
| 0525495 | 2/1993 | European Pat. Off. . |
| 1510854 | 2/1971 | Germany . |
| 4125145 | 2/1993 | Germany . |
| 4331801 | 2/1995 | Germany . |
| 1954522 | 6/1997 | Germany . |

*Primary Examiner*—William Stryjewski
*Attorney, Agent, or Firm*—Robert W. Becker & Associates

[57] ABSTRACT

In a method for a contact-free energy and signal transmission for a textile machine between a first stationary part and a second stationary part separated by an air gap, wherein at least one component consisting of an electrically non-conducting material is moved through the air gap, wherein an alternating current signal of a frequency of at least 10 kHz is inductively transmitted by a transformer, having a primary side arranged at the first stationary part and a secondary side arranged at the second stationary part, wherein the primary side and the secondary side are separated by the air gap, a transformer is employed having only one coil pair. Energy and signals are transmitted via the one coil pair by a common carrier signal. The carrier signal provides energy transmission. The signals to be transmitted are imprinted onto the carrier signal as a frequency modulation such that the carrier signal jumps between two frequency values having a fixed spacing. The frequency jumps are evaluated at the secondary side as bit-serial signals, and control signals are generated from the bit-serial signals.

24 Claims, 5 Drawing Sheets

SECONDARY
PRIMARY
OPTIONAL IF NEEDED
VOLTAGE STABILIZATION
EVALUATION CIRCUIT (ZB.µP)
FUNCTIONAL COMPONENT 1
FUNCTIONAL COMPONENT N
NOMINAL VALUE & CONTROL SIGNAL
CONTROL SIGNALS
POWER SUPPLY
f=15-30KHz
5
4
12
7
11
13
6.2
6.1
6
10

METHOD FOR CONTACT-FREE ENERGY AND SIGNAL TRANSMISSION ON TEXTILE MACHINES, ESPECIALLY TWISTING MACHINES AS WELL AS DEVICE FOR PERFORMING THE METHOD

BACKGROUND OF THE INVENTION

The present invention relates to a method and a device for contact-free energy and signal transmission on textile machines, especially twisting machines. Energy transmission takes place between a first stationary part and a second stationary part separated by an air gap, wherein at least one component consisting of an electrically non-conducting material is moved through the air gap, wherein an alternating current signal of a frequency of at least 10 kHz is inductively transmitted by a transformer, having a primary side arranged at the first stationary part and a secondary side arranged at the second stationary part, wherein the primary side and the secondary side are separated by the air gap, A method and a device with the aforementioned features is known and disclosed for a twisting machine in DE-C-1 510 854. In the known device the energy transmission is performed between the stationarily arranged primary side and the stationarily arranged secondary side of a transformer whereby between the two transformer halves the yarn balloon extends. More details of the embodiment of the transformer are not disclosed in this document. The disclosed embodiments show that the transformer is suitable only for transmission of small power output. This is already indicated by use of an iron core at transmission frequencies of more than 1,000 Hz. For higher power output, i.e., power output above 50 W, the power loss due to the high remagnetization losses could not be dissipated without additional cooling measures. A further disadvantage of the known device is that due to the analog control of the disclosed functional components (change of the primary voltage of the transformer) a plurality of transformer units are required as soon as multiple functional components (for example, brake and motor) are to be controlled. A further principal disadvantage of such an analog control method is that a highly precise control, for example, precise rpm control of motors, cannot be realized because especially for large air gaps the tolerances of the coil windings and the air gap adjustment cannot be maintained with sufficient precision at acceptable expenditure, and data transmission, for example, by a preset nominal value is not possible.

A contact-free transmission of signals and electrical energy is also disclosed in EP-0 525 495 A1. In this known arrangement an axial transformer arrangement with a primary coil and a secondary coil as well as core of ferromagnetic material is used in which, for additional contact-free transmission of changing signals, in direct vicinity of the primary coil and of the secondary coil at least one sender and at least one receiver are arranged which can be alternatingly connected to the electric receiver and the electronic sender device, which are embodied as large-surface antennas and are combined to a common constructive unit with the primary coil, the secondary coil, and/or the core of the transformer.

The primary coil and the secondary coil of the transformer can be arranged so as to be rotatable relative to one another. By employing two such known transformers acting as axial transformers it would be possible, in principle, to transmit in a textile machine energy and signals from a first stationary component through a rotating component to a second stationary component. However, for the high rpm (greater than 10,000 rpm) occurring in textile machines such an arrangement cannot be provided with sufficient operational safety. Tests with such arrangements show again and again the technical limits resulting from insufficient centrifugal force stability of the brittle ferrite material that has the tendency to form cracks. This is also true when the transformer is embodied as a radial transmitter.

Furthermore, in these known arrangements the signal transmission is carried out parallel to the energy transmission on separate paths via additional coils or by coupling elements embodied as inductive or capacitive antennas. If additional windings are used, this results in undesirable large space requirements. When employing antennas, the power and data transmission is conventionally performed by employing different carrier frequencies, i.e., the energy transmission is carried out conventionally in the kHz range while the signal transmission is performed in the MHz range. The expenditures for the required components results in high costs which, especially for textile machines having multiple work stations, cannot be justified.

Document DE 41 25 145 A1 relates to a device for contact-free transmission of electrical energy and changing signals with an axial transformer arrangement with primary and secondary coils and a core made of ferromagnetic material. In direct vicinity of the primary coil and the secondary coil at least one sender and one receiver are arranged which are embodied as large-surface area antennas whereby the primary coil and secondary coil together with the corresponding antennas can be displaced relative to one another or rotated relative to one another. With respect to the use of such devices for energy and signal transmissions the remarks made in regard to the aforementioned document apply here as well.

From DE 195 45 220 A1 an arrangement for contact-free transmission of signals between vehicle components that can be moved linearly relative to one another is known. It is especially suitable for transmission of energy and control signals between the car body of a vehicle and the driver or front passenger seat. The arrangement includes a transmission device having primary and secondary coils in separate half-shell cores which are embodied as rails that can glide along one another and have such a contour that they form a closed circuit for magnetic flow between the primary and the secondary coil. With this arrangement energy and signal transmission at a textile machine through a rotating component is not possible.

It is therefore an object of the invention to improve a method of the aforementioned kind such that across an air gap through which at least one component, for example, a yarn balloon is moved, electrical energy and signals can be transmitted from the first stationary component, for example, the machine frame of a twisting machine, to a second stationary component, for example, a twisting spindle, such that the following conditions are fulfilled:

1) Any number of functional components of the second stationary component can be controlled which second stationary component is surrounded by the movable component;
2) The moved component can rotate at high rpm (for example, more than 10,000 rpm);
3) An energy transmission with power output greater than 50 W across a relatively large air gap (greater than 1 mm) is possible;
4) It is possible to perform data transmission preferably unidirectional, but alternatively also bidirectional, without additional inductive or capacitive coupling elements embodied as antennas.

SUMMARY OF THE INVENTION

The basic idea of the invention is that energy and data or control signals can be transmitted by a common carrier signal onto which the signals to be transmitted are imprinted by frequency modulation. The evaluation of the resulting frequency jumps results in a bit-serial data stream that can be combined to data bytes or data words and can thus provide for any number of functional component any number of control commands and/or preset nominal values.

Functional components arranged in the second stationary component can be in the form of yarn brakes, twisting flyer brakes, but also motors which, for example, serve as drives for the spinning devices which are arranged in the space defined within the twisting spindle within the yarn balloon. Such devices are used for producing a twisted yarn in an integrated spinning and twisting process and are, for example, disclosed in DE 43 31 801 C1.

The device for performing the inventive method is based on the knowledge that a transmission of the required power output is only possible when the used transformer is adapted in a special manner to the respective specifications. With an embodiment as suggested with the present invention in regard to the arrangement of primary and secondary parts of the transformer, it is possible to transmit higher power output while minimizing the apparent power output and remagnetization losses without additional cooling measures being required.

BRIEF DESCRIPTION OF THE DRAWINGS

In the following, embodiments of the inventive method and devices for its performances will be explained in more detail with the aid of the attached drawings.

The drawings show the following.

DESCRIPTION OF PREFERRED EMBODIMENTS

Figure 1:
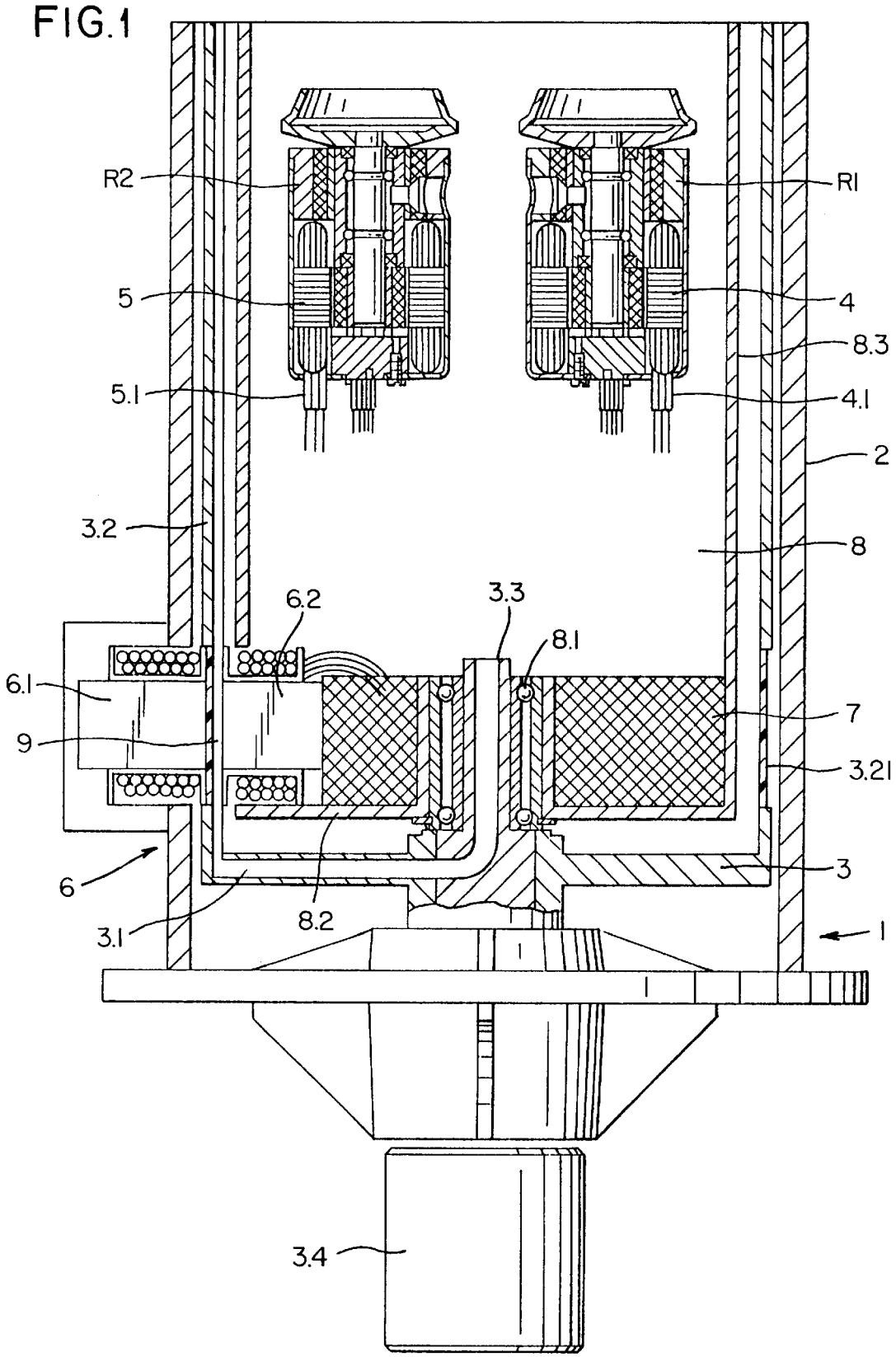
FIG. 1 a very schematic sectional view of a twisting spindle with guided yarn balloon and spinning devices arranged within the twisting spindle to which energy and signals are to be transmitted from the exterior.

FIG. 1 shows in a very schematic representation a two-for-one twisting spindle 1 of a construction as disclosed in DE 43 31 801 C1.

The spindle comprises an outer housing 2 in which a spindle rotor disk 3 is rotatably supported which has a yarn guide channel 3.1 and is driven by a whorl 3.4. The balloon limiter 3.2 as a yarn guide element is connected to the outer circumference of the spindle rotor disk. A yarn guide tube 3.3, embodied as a bent lower end of the hollow spindle axle, opens into the inner end of the yarn guide channel 3.1. Above the spindle rotor disk 3 a chamber 8 supported by a bearing 8.1 is provided so as to be secured against rotation. This chamber has preferably the shape of a cylinder and comprises a bottom 8.2, an outer wall 8.3, and a non-represented removable lid. Within this chamber 8 two rotary spinning devices R1 and R2 are arranged having spinning rotors driven respectively by the electric motors 4 and 5. The electric motors 4 and 5 are connected by electric lines 4.1 and 5.1 to an electronic device 7 which is arranged on the bottom 8.2 of the chamber 8. The component device 7 is connected to the secondary part 6.2 of the transformer 6 having a primary part 6.1 fixedly connected to the wall of the outer housing 2.

Figure 2:
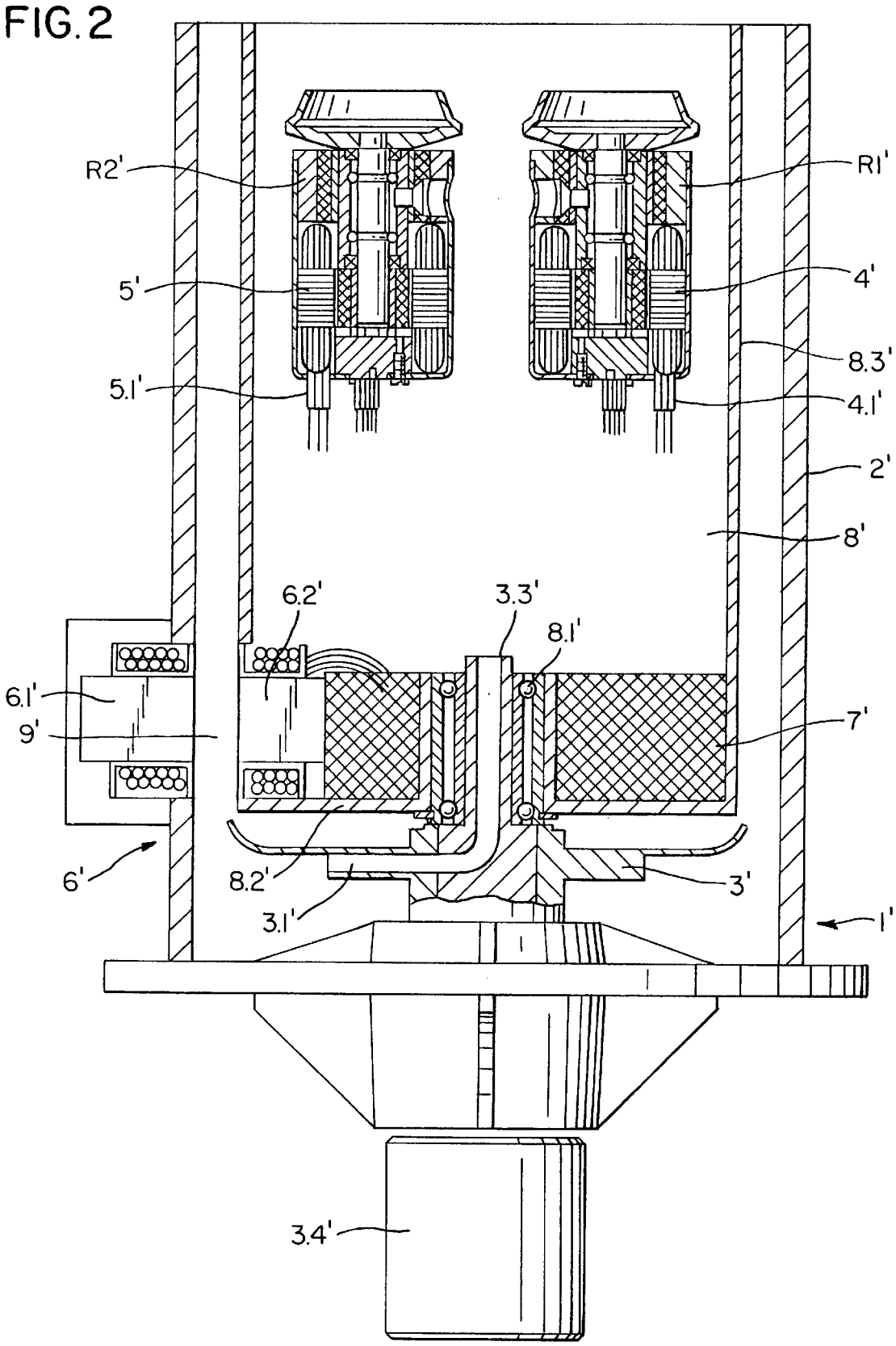
FIG. 2 a representation in analogy to FIG. 1 of a twisting spindle with free yarn balloon and two spinning devices to be supplied from the exterior with energy and signals.

It should be noted that in FIGS. 1 and 2 all unimportant parts of the twisting spindle not required for suppling and controlling the electric motors 4 and 5 have been eliminated.

During operation, dissolved fiber material is guided into the rotary spinning devices R1 and R2 in a manner not disclosed in detail and is guided from the exterior through the yarn balloon. The spun yarns, produced in the spinning rotors according to the conventional open end method, are removed in the upward direction from the upwardly open spinning rotors and are then combined at a non-represented combining point, where they are formed to a twisted yarn according to the two-for-one twisting principle by being removed axially through the two-for-one twisting spindle along the spindle axle and, after exiting from the radially extending yarn guide channel 3.1, are then further guided by forming a yarn balloon to a non-represented centering point positioned on an extension of the hollow spindle axle from where they are then guided to a conventional yarn winding device.

Details for this can be taken from DE 43 31 801 C1.

In FIG. 2 another embodiment of a twisting spindle is represented which differs from the embodiment according to FIG. 1 only in that a free yarn balloon is used so that the balloon limiter connected to the spindle rotor disk is eliminated. FIG. 2 uses the same reference numerals for the same parts as FIG. 1; however, they have an apostrophe added thereto. With respect to the design of the spindle, reference is made to the description of FIG. 1.

In both embodiments the electrical energy for driving the electrical motor 4, 5 and 4'; 5' is supplied by the transformers 6 or 6'. Furthermore, signals for controlling the two electric motors are also supplied by the transformer 6 or 6'. This will be explained in the following in more detail.

Figure 3:
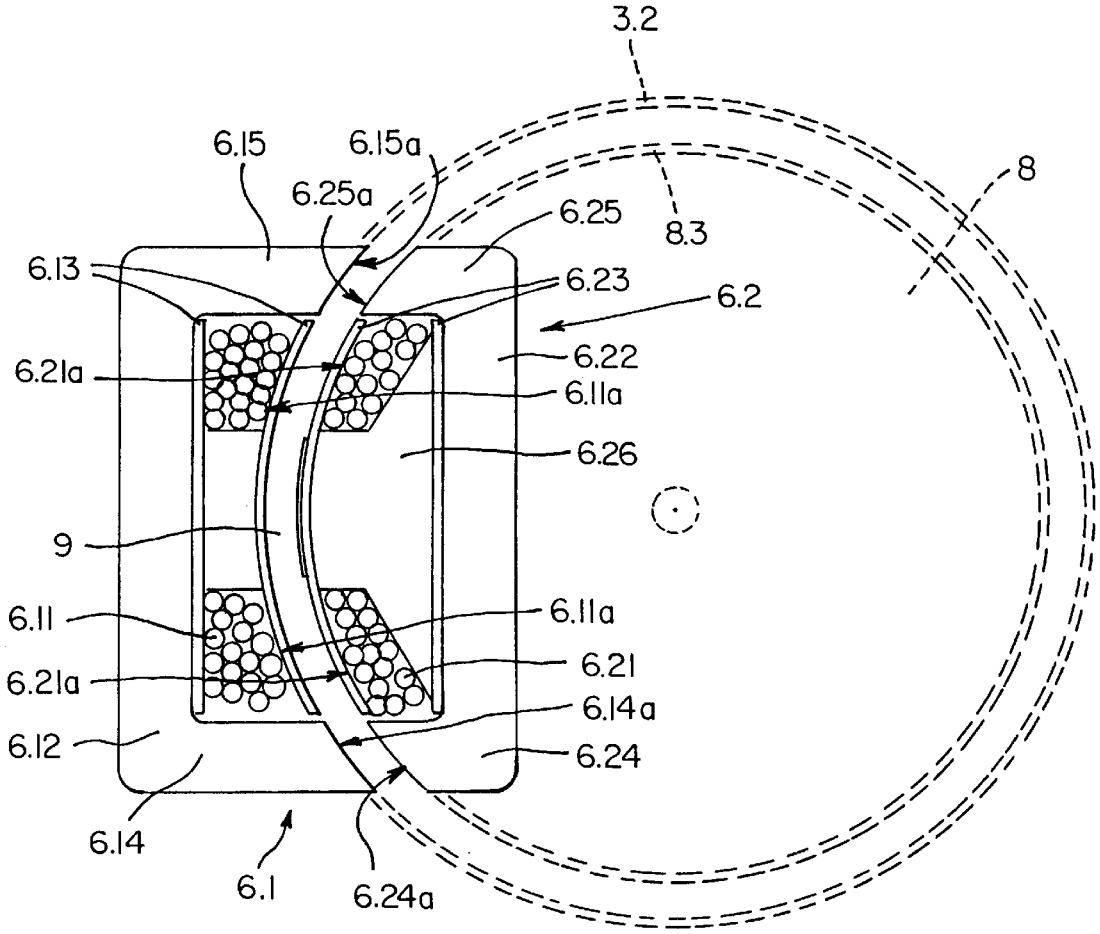
FIG. 3 in horizontal section the embodiment of the transformer for energy and signal transmission for the twisting spindles according to FIG. 1 and FIG. 2.

FIG. 3 shows in an enlarged representation the arrangement of transformer 6 at the twisting spindle which is only shown in a dashed line. The primary side of the transformer 6 is arranged at the wall 3.2 of the stationary outer housing while the secondary side 6.2 is arranged at the wall 8.3 of the chamber 8 which is also stationary. Between these two stationary walls an air gap 9 is provided having a width that is sufficient to allow the yarn balloon, and in the embodiment according to FIG. 1 also the balloon limiter, to move therethrough.

The primary side 6.1 of the transformer 6 comprises a primary coil 6.11 which is wound onto a spool body 6.13 as well as a preferably U-shaped core E-shaped core made of ferrite. The secondary side comprises a secondary coil 6.21 which is wound onto a spool carrier 6.23 as well as preferably a U-shaped or E-shaped core 6.22. The two cores are axially aligned with one another and are spaced by a spacing of the width of the air gap 9 from one another. As can be seen in FIG. 3, the two ferrite cores 6.12; 6.22 with respect to the length of their legs 6.14, 6.15; 6.24, 6.25 and the embodiment of the end faces 6.14*a*, 6.15*a*; 6.24*a*, 6.25*a* of the legs 6.14, 6.15; 6.24, 6.25 are adapted to the contour of the air gap 9 and follow its curvature. The spacing of the outer legs 6.14, 6.15; 6.24, 6.25 of each core 6.12; 6.22 is a multiple (preferably greater than 4) of the width of the air gap 9, which is preferably greater than 2 mm. The components rotating between the primary and secondary sides of the transformer 6 must be embodied of an electrically non-conducting material, and accordingly, in the embodiment according to FIG. 1, the balloon limiter 3.2 has in the area that passes through the transformer 6 a window 3.21 that is closed off by a plastic material.

As can be further seen in FIG. 3, the primary side 6.1 as well as the secondary side 6.2 have arranged thereat coils 6.11; 6.21 such that the sides 6.11*a*; 6.21*a* facing the air gap 9 are also adapted to the contour of the air gap and follow its curvature. In this manner, the coils 6.11; 6.22 are arranged with the shortest possible spacing at the air gap 9. The secondary coil 6.21 is embodied such that the parts facing away from air gap 9 are also adapted to the air gap contour and substantially follow its curvature. This is achieved by a part 6.26 of the spool carrier provided with slanted surfaces.

The transmission of electrical energy is carried out within a medium frequency (10 kHz to 30 kHz) in order to be able to realize acceptable constructive sizes. By employing ferrite cores, remagnetization losses are minimal, and for higher power output no additional cooling measures must be provided. For example, the following output data could be realized:

| | |
|---|---|
| width of air gap | 4.5 mm |
| efficiency | 93% |
| transmitted power | approximately 400 W–500 W |
| required apparent output | approximately 2,500 VA |

Of course, it is possible to eliminate in the embodiment of the transformer 6 the spool body as a coil support whereby a pre-manufactured, fixed coil can be attached to the core by encapsulation.

Since in addition to the electric energy required for driving the electric motors 4 and 5 data for preset nominal values of the motor operation are to be transmitted also via the transformer 6, this data transmission will be explained with the aid of FIGS. 4 as well as 5*a* through 5*c*.

Figure 4:
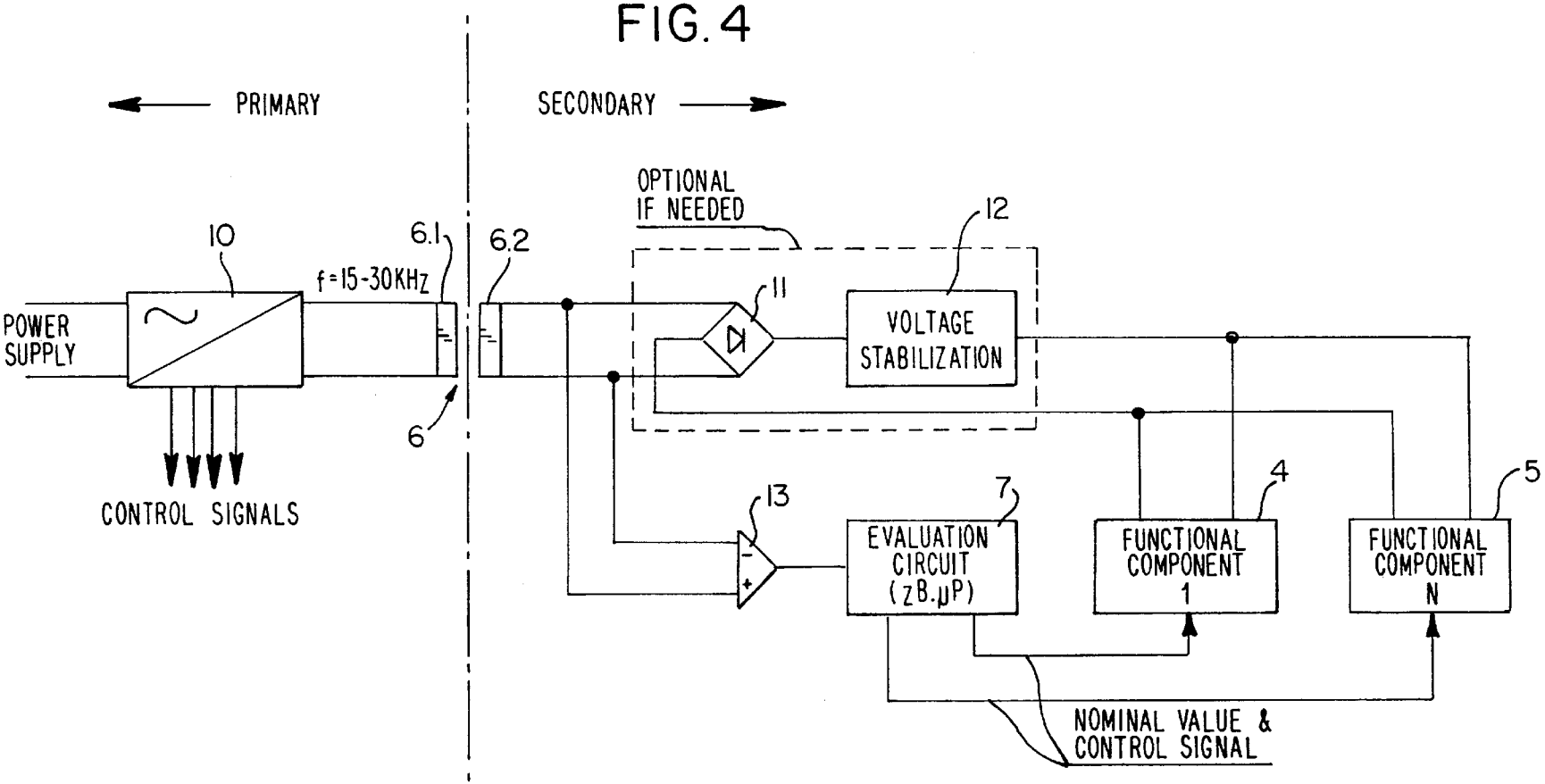
FIG. 4 a basic circuit diagram of the electronic components of the device for energy and signal transmission for the twisting spindles according to FIG. 1 or FIG. 2.

FIG. 4 shows in a basic circuit diagram the circuit for supplying electrical energy as well as signals from the exterior via the transformer 6 into the interior of the twisting spindle 1 or 1'.

The single coil of the primary side 6.1 of the transformer 6 is connected to the output terminal of the control unit 10 to which, in addition to the power supply voltage, control signals (for example, start, stop, rpm) are supplied in a non-represented manner. In this control unit 10, the generated carrier signal here, which may have a frequency between 10 kHz and 30 kHz and serves for energy transmission is imprinted with a frequency modulation which is control-signal specific and corresponds to the control signals. The resulting frequency-modulated signal is transmitted by the primary side 6.1 of the transformer 6 onto the secondary side 6.2. Thus, in addition to the energy transmission there is also a data transmission performed by the same coils of the primary side and the secondary side.

The secondary side 6.2 is connected by a rectifier bridge 11 and optionally a voltage stabilization 12 to the input terminal of components which are identified in FIG. 4 as functional component 1 and functional component N. In the shown embodiment they are the two electric motors 4 and 5. Of course, further functional components of the twisting spindle can also be connected. Furthermore, the secondary side 6.2 of the transformer 6 is connected by an amplifier 13, which operates as a voltage comparator, to the electronic device 7 referred to as the evaluation circuit in the interior of the chamber 8 of the twisting spindle. This electronic device, which may comprise microprocessor, evaluates the resulting frequency changes according to the following method.

Figures 5A, 5B, 5C:
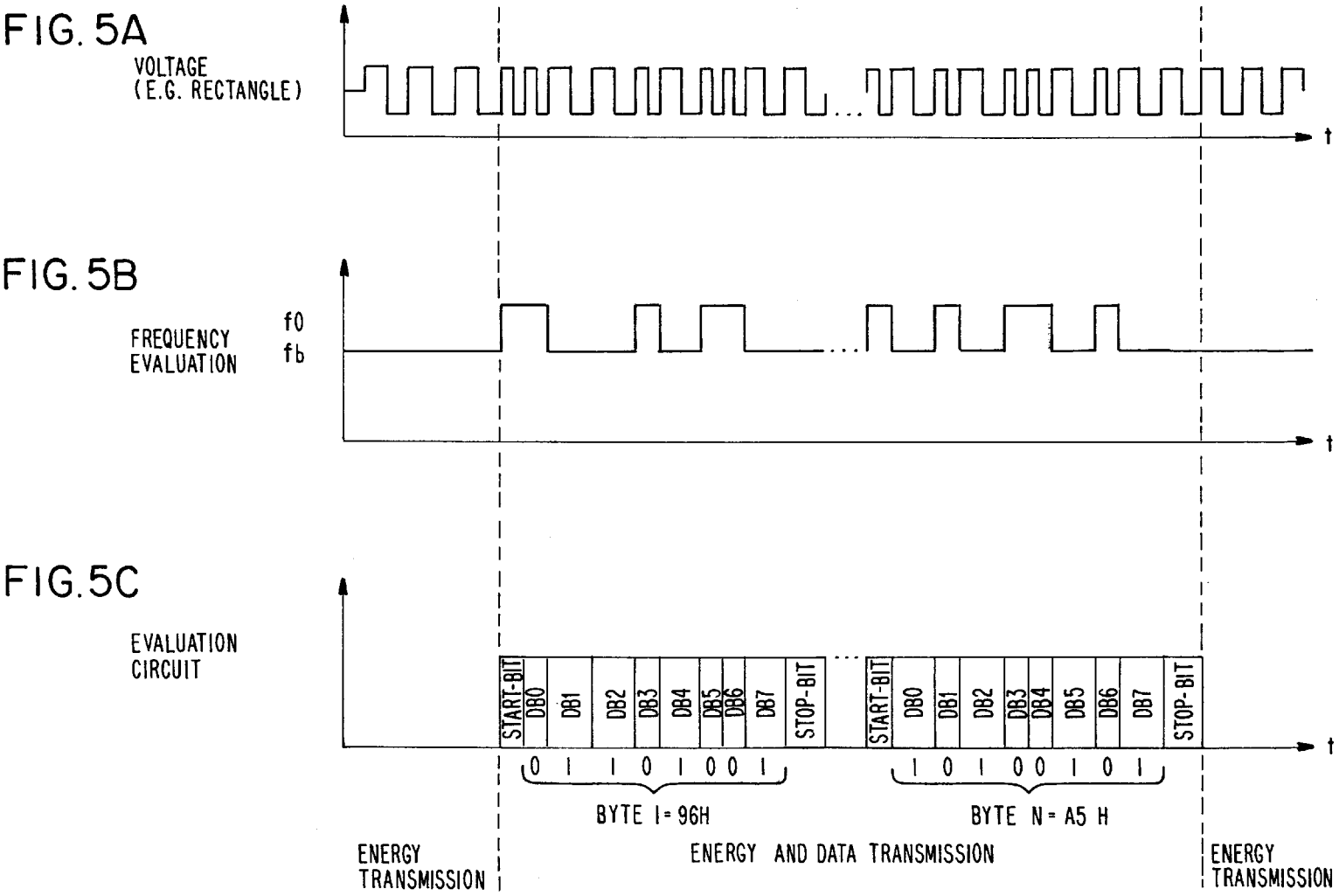
FIGS. 5A through 5C explain in time diagrams an embodiment for a bit-serial transmission method of signals by frequency modulation.

FIG. 5*a* shows a possible time line of the voltage course of the frequency modulated primary voltage/secondary voltage generated by the control unit 10. These signals in the shown embodiment are of a rectangular shape. However, they can be sine wave shaped or rectangular. After passing through the amplifier 13, which is switched as a voltage comparator, a rectangular voltage is provided at the input of the evaluation circuit 7, independent of the rectangular or sinus-wave shape of the supplied voltage. As long as no data are transmitted, the electronic circuit 7 is supplied with the supply voltage of frequency $f_B$ (base frequency). As soon as data are transmitted, the frequency of the supply voltage is changed accordingly to the transmitted bit pattern between the base frequency $f_{off}$ and a second frequency $_{of}$ (offset frequency). These frequency jumps detected by the electronic device are represented in FIG. 5*b*. In the electronic device 7 the frequency changes are evaluated like level changes in a synchronous transmission methods. The interpretation of the signals in the evaluation circuit is illustrated in FIG. 5*c*. For transmitting a high level (bit=1) the frequency $f_B$ and for transmitting a low level (bit=0) the frequency $_{off}$ is applied. It is possible to have the frequency $_{of}$ greater or smaller than the base frequency $f_{off}$ whereby the frequency/level coordination is interpreted or evaluated by the control unit 10 and the evaluation circuit 7 in the same manner. A high/low flank change is interpreted as a start bit.

In FIGS. 5A through 5C a method is represented in which the frequency change within a period length of the supplied alternating current is evaluated. Of course, it is also possible to employ periodic integers N for detecting the frequency change in order to increase the failure safety of the method, for example, by averaging. In a further variant, it is also possible to define different integers of the sequential impulses of identical frequency whereby the integers N and M for the two frequencies must be selected to be so different that substantially the same time for the transmission of low and high levels will result (this is very similar to the conventional a synchronous transmission method). Due to the unavoidable disturbance signals of such transmission paths it is useful in all aforementioned variants to evaluate by the electronic evaluation circuit the flank changes in such time windows which correspond to the defined period length of base frequency and off set frequency.

In the evaluation method represented in FIG. 5C a ten bit frame (one start bit, eight data bits, and one stop bit) are used. The transmitted bits are then combined by the evaluation device to a data word (byte). Of course, the bits can also be combined to data structures comprised of any suitable number of data bytes. In this method the defined data structure can be used for transmitting any suitable different nominal values or control signals. A transmitted data block can be secured in a known manner by summation (for example, CRC check) so that transmission errors can be detected and taken into consideration by the evaluation device. Transmission errors result in standstill of the controlled motors. This can be detected outside of the rotating device unit by simple sensors.

Alternatively, the electronic evaluation device can cause a modulation of the power intake which is evaluated by the current sensors in the convertor of the primary side energy supply. An error-free data transmission can thus be acknowledged.

When using such current sensors, according to a further variant of the invention, any suitable data blocks can be transmitted and detected by current modulation so that a bidirectional data transmission is possible.

The specification incorporates by reference the disclosure of German priority document 197 35 651.6 of Aug. 16, 1997.

The present invention is, of course, in no way restricted to the specific disclosure of the specification and drawings, but also encompasses any modifications within the scope of the appended claims.

What is claimed is:

1. A method for a contact-free energy and signal transmission for a textile machine between a first stationary part and a second stationary part separated by an air gap (9, 9'), wherein at least one electrically non-conducting component, selected from the group consisting of a yarn balloon and a yarn guiding element, is moved through said air gap (9, 9'), wherein an alternating current signal of a frequency of at least 10 kHz is inductively transmitted by a transformer (6, 6'), having a primary side (6.1, 6.1') arranged at said first stationary part and a secondary side (6.2, 6.2') arranged at said second stationary part, wherein said primary side (6.1, 6.1') and said secondary side (6.2, 6.2') are separated by said air gap (9, 9'), said method comprising the steps of:

providing said transformer (6,6') with only one coil pair (6.11, 6.21) having two coils, wherein one of said coils is connected to said first stationary part and the other one of said coils is connected to said second stationary part;

transmitting energy and signals via said one coil pair (6.11, 6.21) by a common carrier signal, wherein said carrier signal provides energy transmission;

imprinting the signals to be transmitted into said carrier signal as a frequency modulation such that said carrier signal jumps between two frequency values having a fixed spacing;

evaluating said frequency jumps at the secondary side as bit-serial signals; and generating control signals from said bit-serial signals.

2. A method according to claim 1, wherein said first stationary part is a machine frame of a two-for-one twister, said second stationary part is a twisting spindle (1, 1'), and said component is a yarn balloon.

3. A method according to claim 1, wherein in said step of evaluating said frequency jumps are evaluated within period length of said carrier signal.

4. A method according to claim 1, wherein in said step of imprinting said frequency jumps are imprinted onto said carrier signal with a preset number of periods and wherein in said step of evaluating said frequency jumps are evaluated within the length of said periods.

5. A method according to claim 4, wherein said number of periods is identical for said two frequency values.

6. A method according to claim 4, wherein said number of periods is different for said frequency values.

7. A method according to claim 6, wherein said numbers of periods are selected to be so different for said two frequency values that substantially identical transmission times result for said two frequency values.

8. A method according to claim 1, further including the step of combining bits of the bit-serial signals to data words or data blocks.

9. A method according to claim 8, further including the step of checking said data words or data blocks by summation.

10. A method according to claim 9, further including the step of shutting down energy and signal transmission upon realization of a transmission error.

11. A method according to claim 9, further including the step of emitting warning signals upon realization of a transmission error.

12. A method according to claim 9, further including the steps of shutting down energy and signal transmission and of emitting warning signals upon realization of a transmission error.

13. A method according to claim 9, further including the step of monitoring current supply of the power supply and evaluating current changes for generating acknowledgment signals.

14. A device for a contact-free energy and signal transmission for a textile machine between a first stationary cylindrical part (2, 2') and a second stationary cylindrical part (8.3, 8.3') separated by a curved air gap (9, 9'), wherein at least one electrically non-conducting component, selected from the group consisting of a yarn balloon and a yarn guide element, is moved through said air gap (9, 9'), said device comprising:

a transformer (6, 6'), having a primary side (6,1, 6.1') arranged at the first stationary part and a secondary side (6.2, 6.2') arranged at the second stationary part and separated by said air gap (9, 9');

said primary side having a primary coil (6.11) wound about a primary core (6.12) and said secondary side having a secondary coil (6.21, 6.21') wound about a secondary core (6.22);

an alternating current generator connected to said primary side (6.1, 6.1') of said transformer (6, 6');

an electrical device (7, 7') connected to said secondary side (6.2, 6.2');

said primary and said secondary core (6.12, 6.22) having facing sides matching a curvature of said air gap (9, 9');

said primary core (6.12) having spaced apart legs (6.14, 6.15), wherein a distance between said legs is a multiple of a width of said air gap (9, 9');

said secondary core (6.22) having spaced apart legs (6.24, 6.25), wherein a distance between said legs is a multiple of a width of said air gap (9, 9').

15. A device according to claim 14, wherein said spaced apart legs (6.14, 6.15; 6.24, 6.25) of said primary and secondary cores (6.12, 6.22) have opposed end faces (6.14*a*, 6.15*a*; 6.24*a*, 6.25*a*) facing said air gap (9, 9') and wherein said opposed end faces (6.14*a*, 6.15*a*; 6.24*a*, 6.25*a*) match the curvature of said air gap (9, 9').

16. A device according to claim 14, wherein said primary and secondary coils (6.11,6.21) have opposing sides (6.11*a*, 6.21*a*) facing said air gap (9, 9') and wherein said opposing sides (6.1*a*, 6.21*a*) match the curvature of said air gap (9, 9') and are located at closest possible spacing to said air gap (9, 9').

17. A device according to claim 14, wherein parts of said primary and secondary cores (6.12, 6.22) and said primary and secondary coils (6.11, 6.21) match the curvature of said air gap (9, 9').

18. A device according to claim 14, wherein said air gap (9, 9') is greater than 2 mm.

19. A device according to claim 14, wherein said primary and secondary cores (6.12, 6.22) have a U-shape or an E-shape.

20. A device according to claim 14, wherein said spacing between said spaced apart legs (6.14, 6.15; 6.24, 6.25) is 4 times said width of said air gap (9, 9').

21. A device according to claim 14, wherein a radius of the curvature of said air gap (9, 9') is 40–100 mm.

22. A device according to claim 14, wherein said primary and secondary cores (6.12, 6.22) are ferrite cores.

23. A device according to claim 14, comprising an evaluation circuit (7), connected to said secondary side, for generating control signals, wherein said evaluation circuit (7) is connected to functional components of said second stationary part.

24. A device according to claim 23, wherein said functional components are electric motors (4, 5) for driving rotary spinning devices (R1, R2).

* * * * *